United States Patent [19]

Salzer

[11] 3,986,158

[45] Oct. 12, 1976

[54] ELECTRIC FUSE HAVING CASING OF SYNTHETIC-RESIN-GLASS-CLOTH LAMINATE

[75] Inventor: Erwin Salzer, Waban, Mass.

[73] Assignee: The Chase-Shawmut Company, Newburyport, Mass.

[22] Filed: Sept. 18, 1975

[21] Appl. No.: 614,361

[52] U.S. Cl. ..... 337/246; 337/186; 337/228

[51] Int. Cl.[2] ..... H01H 85/02

[58] Field of Search ..... 337/246, 201, 207, 186, 337/228, 208, 213, 247; 29/623

[56] References Cited

UNITED STATES PATENTS

| | | | |
|---|---|---|---|
| 2,328,825 | 9/1943 | McMahon | 337/246 |
| 3,911,385 | 10/1975 | Blewitt et al. | 337/186 |

FOREIGN PATENTS OR APPLICATIONS

| | | | |
|---|---|---|---|
| 704,315 | 2/1965 | Canada | 337/246 |

*Primary Examiner*—Harold Broome
*Attorney, Agent, or Firm*—Erwin Salzer

[57] ABSTRACT

A fuse having a composite casing. It includes a radially inner tubular portion that is circular in cross-section, of uniform wall thickness, and houses the fusible element means and a body of pulverulent arc-quenching filler. The casing structure further includes a plurality of angularly displaced rods of an electric insulating material having substantially the same length as the tubular portion of uniform wall thickness of the casing arranged parallel to the axis of said tubular portion, in abutting relation to the outer surface thereof, and adhesively affixed to said outer surface. A pair of spaced external terminal plates closes the tubular portion of the casing and is provided with fasteners having shanks projecting into the end surfaces of said plurality of rods.

6 Claims, 12 Drawing Figures

ELECTRIC FUSE HAVING CASING OF SYNTHETIC-RESIN-GLASS-CLOTH LAMINATE

BACKGROUND OF THE INVENTION

The most suitable and most widely used materials for casings of electric fuses are ceramic materials and synthetic-glass-cloth laminates. If one chooses a ceramic material, one foregoes all of the many significant advantages offered for the particular purpose by synthetic-resin-glass-cloth laminates, and vice versa.

It is one of the objects of the invention to provide electric fuses having casings of synthetic-glass-cloth laminates which have desirable features which were, heretofore, only found in fuses having casings of a ceramic material.

Another object of the invention is to provide fuses the casings of which have portions which are of a pultruded tubing material of uniform wall thickness that is reinforced by a squirrel-cage-like structure surrounding the same, which fuses can be manufactured at moderate cost.

Other objects and advantages of the invention will become more apparent from what follows.

SUMMARY OF THE INVENTION

Fuses embodying this invention have a tubular casing portion circular in cross-section having a wall of uniform thickness of a synthetic-resin-glass-cloth laminate. Said casing portion houses fusible element means and a granular arc-quenching filler and is closed at the ends thereof by a pair of terminal plates. These terminal plates are conductively interconnected by said fusible element means and are juxtaposed to the axially outer edges of the aforementioned tubular casing portion. A plurality of angularly displaced rods of an electric insulating material having substantially the same length as the aforementioned casing portion is arranged parallel to the axis and in abutting relation to the outer surface thereof. A plurality of fasteners projects transversely through bores in said pair of terminal plates into the end surfaces of said plurality of rods, thus affixing said pair of terminal plates to said casing portion.

BRIEF DESCRIPTION OF PREFERRED EMBODIMENTS

It appears desirable to present as an introduction to what follows a brief description of typical prior art designs to establish an appropriate background for a better appreciation of the present invention.

Figure 1A:
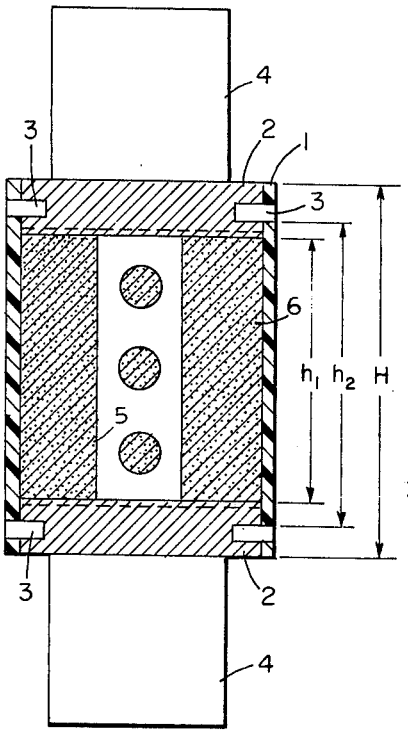
FIGS. 1*a* and 1*b* show a prior art fuse diagrammatically substantially in vertical section along 1*a*—1*a* of FIG. 1*b* and in top plan view.
Figure 2A:
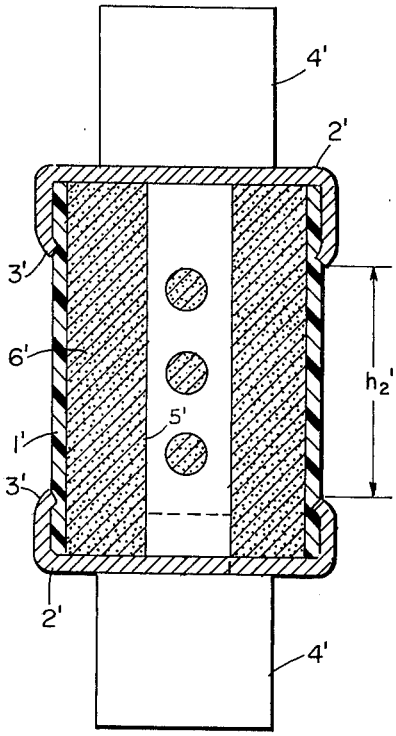
FIGS. 2*a* and 2*b* show a prior art fuse diagrammatically in vertical section substantially along 2*a*—2*a* of FIG. 2*b* and in top plan view.
Figure 3A:
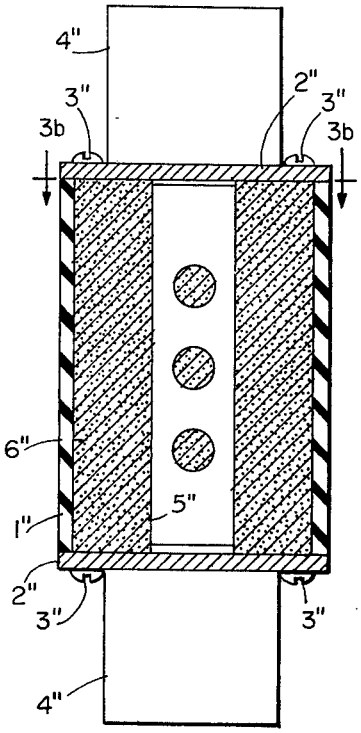
FIGS. 3*a* and 3*b* show a prior art fuse diagrammatically in vertical section along 3*a*—3*a* of FIG. 3*b* and in horizontal section along 3*b*—3*b* of FIG. 3*a*, respectively.

The fuses shown in FIGS. 1*a*, 2*a* and 3*a* have casings of equal height H.

Figure 1B:
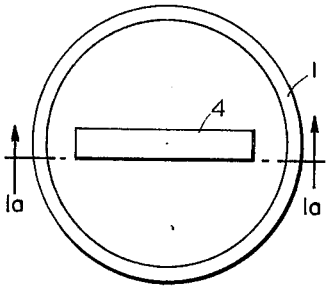

FIGS. 1*a* and 1*b* show a typical fuse of the plug terminal type. The fuse includes a tubular casing 1 of a synthetic-resin-glass-cloth laminate. Casing 1 is closed on both ends thereof by plug terminals 2 press-fitted into the ends of casing 1 and affixed to the latter by steel pins 3 projecting radially through casing 1 into plug terminals 2. Each of plug terminals 2 is provided with a blade contact 4. Plug terminals 2 are conductively interconnected by a multiperforated fusible element 5 embedded in a granular arc-quenching filler 6, e.g. quartz sand. The distance $h_1$ between the axially inner end surfaces of plug terminals 2 determines to a large extent the length of fusible element 5, and the arc voltage generated incident to blowing of the fuse. Since $h_1 << H$, this fact may in certain instances impose severe limitations upon plug terminal type fuses. The distance $h_2 < H$, i.e. the external distance between parts which are at different voltage levels when the fuse is not current-carrying is less than the length of the casing of the fuse and this fact may, in certain instances, impose limitations upon plug terminal type fuses.

Figure 2B:
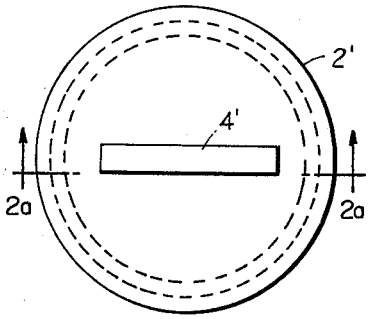

FIG. 2*a* and 2*b* show a typical fuse of the ferrule terminal type. The fuse includes a tubular casing 1' of synthetic-resin-glass-cloth laminate. Casing 1' is closed on boths ends thereof by ferrules or caps 2' mounted upon the outer surface of casing 1'. The axially inner edges of ferrules 2' are crimped as shown at 3' into casing 1' which, to this end, may be provided with two annular grooves for receiving the radially inwardly crimped edges of ferrules 2'. Ferrules 2' are provided with blade contact 4' and conductively interconnected by a multiperforated fusible element 5' embedded in a granular arc-quenching filler 6', e.g. quartz sand. The spacing $h_2'$ between the axially inner edges of ferrules 2' is considerably less than the length H of casing 1'. This fact may present a limitation if it is intended to make the fuse as compact as possible, i.e. to minimize H, and the fuse is intended to be used in a circuit having a relatively high voltage rating.

Figure 3B:
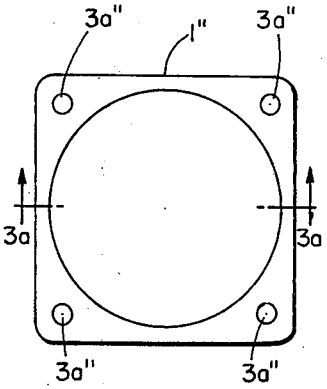
FIG. 3b prior art

Referring now to FIGS. 3*a* and 3*b*, the fuse shown therein has a casing 1'' which is substantially square in cross-section on the outside and substantially circular in cross-section on the inside thereof. As a result, the wall thickness of the casing is relatively large adjacent its four vertical rounded edges and is relatively small midway between these edges. Casing 1 is closed on both ends thereof by relatively thin terminal plates 2'' arranged exteriorly of casing 1'', provided with blade contacts 4'' and screwed by screws 3'' against the end surfaces of casing 1''. Screws 3'' project into internally screw-threaded recesses 3*a*'' in casing 1''. Terminal plates 2'''' are conductively interconnected by fusible element means 5'' embedded in granular arc-quenching filler 6'' inside of casing 1''. The latter is made of a ceramic material, e.g. steatite, or the like, since the geometry thereof does not lend itself to fabrication by a synthetic-resin-glass-cloth laminate.

The structure of FIGS. 3*a* and 3*b* is desirable because of its low assembly cost. It has also the advantage that the spacing between the axially inner surfaces of terminal plates 2'' is equal rather than less than the height H of casing 1''. It is subject to all the limitations of fired ceramic materials such as, for instance, lack of machinability, relatively large tolerances, limited heat-shock resistance, limited dynamic bursting strength, failure to evolve gases under the heat of the arc which help to quench the arc and form a thermal barrier between the casing proper and its hot contents formed therein incident to blowing of the fuse, etc.

The present state of the art does not make it possible to manufacture a synthetic resin-glass-cloth laminate that has the shape of the casing of FIGS. 3*a* and 3*b* and the required bursting strength. Prior art thermosetting synthetic resins manufacturing methods have not resulted satisfactory casings having the geometry of FIGS. 3*a* and 3*b*.

The structures embodying this invention are not subject to the aforementioned limitations of prior art structures.

Figure 4:
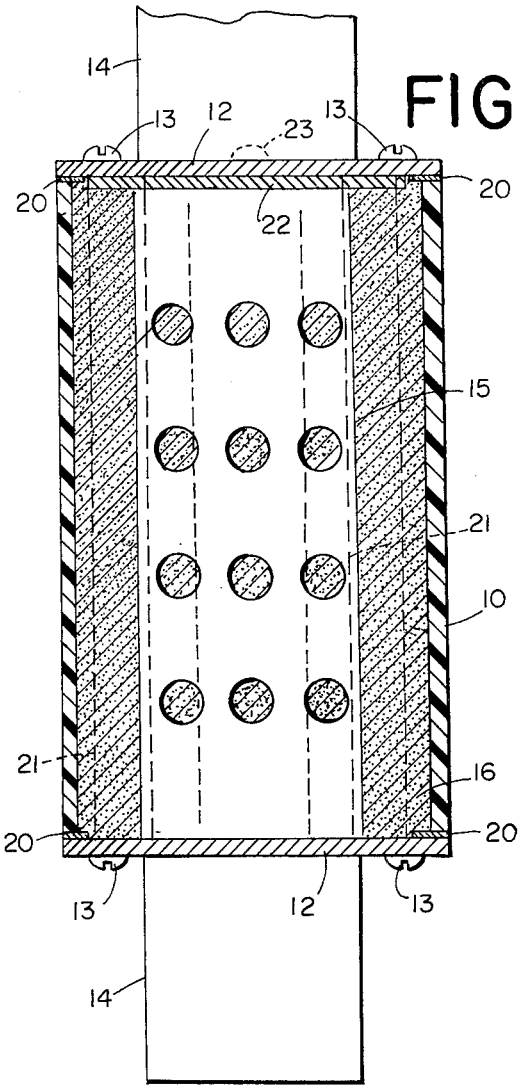
FIG. 4 shows a fuse embodying this invention in a vertical section taken along 4—4 of FIG. 5.
Figure 5:
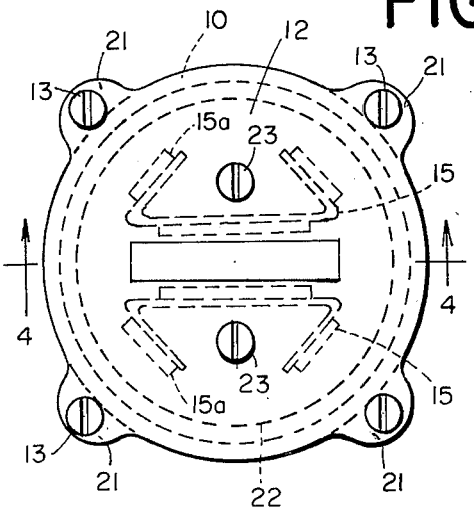
FIG. 5 shows the structure of FIG. 4 in top plan view.
Figure 9:
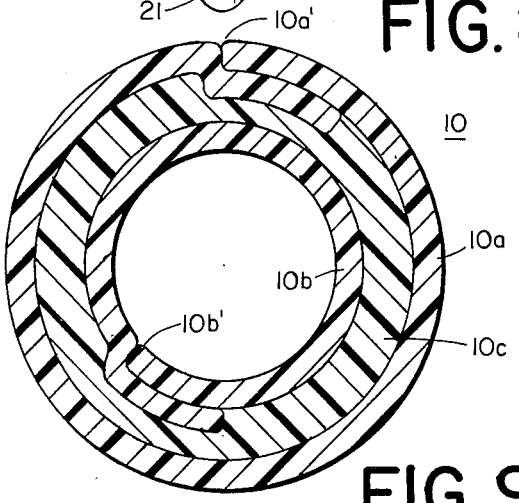
FIG. 9 is a diagrammatic representation of the glass fiber reinforcement of the casing structure of FIG. 8.

Referring now to FIGS. 4–8, inclusive, numeral 10 has been applied to indicate a tubular casing portion of a synthetic-resin-glass-cloth laminate. The wall thickness of casing 10 is uniform along the entire perimeter thereof. Casing 10 is preferably a multiply casing as shown in FIG. 9 and described in its context. It houses fusible element means 15 which are in the form of multi-perforated ribbons forming serially arranged points of reduced cross-sectional area. As shown in FIG. 5 fusible elements 15 are substantially channel-shaped. Casing 10 further houses a body of granular or pulverulent filler 16 which embeds the fusible element means 15. Reference numeral 12 has been applied to indicate a pair of spaced terminal plates conductively interconnected by fusible element means 15. Each of terminal plates 12 is provided with a blade contact 14. Terminal plates 12 are arranged externally of casing 10 and a seal or gasket 20 is interposed between each of the end surfaces of casing 10 and the axially inner end surfaces of terminal plates 12.

A plurality of angularly displaced rods 21 of electric insulating material having substantially the same length as casing 10 is arranged parallel to the axis thereof and in abutting relation to the outer surface of casing 10. Each of said plurality of rods 21 is affixed to casing 10 and has a radially inner surface 21*a* conforming to a strip of the outer surface of casing 10 extending in a direction longitudinally thereof. (See particularly FIG. 8). Each of rods 21 is preferably adhesively bonded to the outer surface of casing 10. Reference numeral 13 has been applied to indicate a plurality of fasteners having shanks projecting transversely through bores in terminal plates 12 into the end surfaces of said plurality of rods, thus affixing the pair of terminal plates 12 to casing 10.

Rods 21 are preferably made of synthetic resin. However, rods 21 should preferably be of a non-glass-cloth reinforced synthetic resin. The end surfaces of rods 21 are provided with axially extending bores 21*b* for receiving the shanks of fasteners 13. Fasteners 13 may be screws or self-tapping screws and bores 21 may be provided with internal screw-threaded metallic inserts for receiving the shanks of screws 13 for affixing terminal plates 12 to rods 21.

Figure 6:
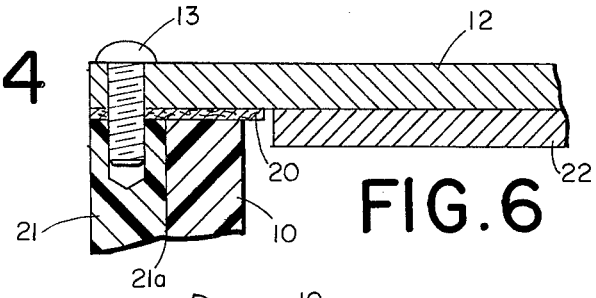
FIG. 6 shows on a larger scale a detail of the structure of FIGS. 4 and 5, and is a section along 6—6 of FIG. 7.
Figure 7:
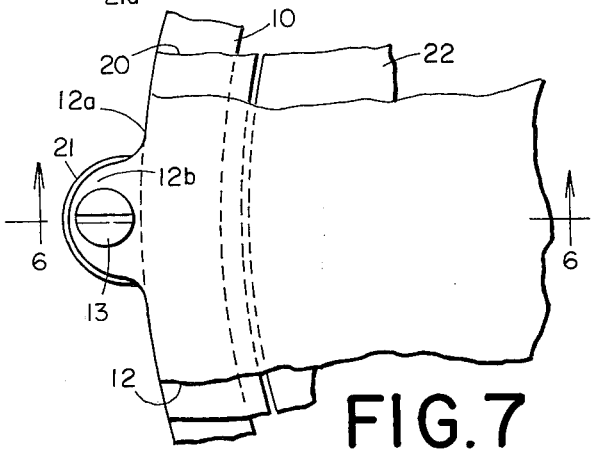
FIG. 7 is a top plan view of the structure of FIG. 6 showing some parts thereof broken away to expose other parts thereof to view.
Figure 8:
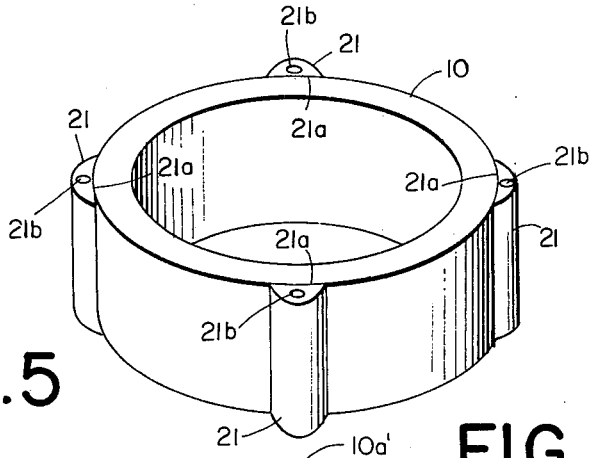
FIG. 8 is an isometric view of the casing and rod structure of a fuse similar to that shown in FIGS. 4 and 5 but shorter than the latter.

The lower ends of fusible elements 15 are preferably spot-welded by means of spot-welding tabs 15*a* to lower terminal plate 12. The upper ends of fusible elements 15 are spot-welded by means of spot-welding tabs 15*a* to a sub-terminal plate 22 arranged below the upper terminal plate 12 (as seen in FIGS. 4 and 6) and mechanically affixed and conductively connected to upper terminal plate 12 by means of screws 23.

Each of both terminal plates 12 includes a circular center portion 12*a* having substantially the same diameter as the outer diameter of casing 10. Center portions 12*a* of terminal plates 12 are provided with a plurality of angularly displaced radially outwardly projecting lugs 12*b* arranged in registry with the end surfaces of said plurality of rods 21 and having bores for fasteners 13 that project through lugs 12*b* into the end surfaces of rods 21.

It will be apparent that rods 21 and plates 12 form a squirrel-cage-like structure that tends to increase significantly the bursting strength of the tubular casing portion 10 having a uniform wall thickness along its entire periphery. The co-pending patent application of Daniel P. Healey, Jr., filed May 22, 1975, Ser. No. 579,972 for ELECTRIC FUSE HAVING A MULTIPLY CASING OF SYNTHETIC- RESIN-GLASS-CLOTH LAMINATE discloses and claims a fuse structure having a multiply casing produced by the pultrusion process. The larger the internal pressure per unit of internal surface, the larger the number of plies required to impart the required bursting strength to a fuse structure of the kind disclosed in the above patent application of Healey. The presence of, or addition of, a squirrel-cage like structure as the structure 21,12 described above allows to reduce the number of plies in a fuse having a pultruded casing as disclosed by Healey, all other parameters remaining unchanged.

In FIG. 9 reference character 10 has been applied to generally designate a tubular structure of a synthetic-resin-glass-cloth laminate as also shown in FIGS. 4–8. The laminate shown in FIG. 9 includes three reinforcements of glass fibers indicated by the hatching thereof. The outermost ply 10*a* and the innermost ply 10*b* are of woven glass fiber cloth. Ply 10*a* overlaps at 10*a'* and ply 10*b* overlaps at 10*b'*. Reference numeral 10c has been applied to indicate an intermediate ply of non-woven mat material made-up of irregularly oriented, or randomly oriented, glass fibers. The overlap regions 10*a'* and 10*b'* are compressed by the pultrusion process into the mat material of relatively small fiber density. This allows to achieve a uniform wall thickness along the entire periphery of structure 10 in spite of the fact that the thickness of plies 10*a*, 10*b* at overlap regions 10*a'*, 10*b'* is about twice that at all other points along the perimeter of structure 10.

For a more detailed description of pultruded high dynamic bursting strength fuse casings reference may be had to the above referred-to patent application of Daniel P. Healey.

For a better understanding of the invention it is desirable to consider the stresses to which the casing of a fuse is subjected under severe interrupting conditions. Under such conditions the fusion and vaporization of the fusible element is in the nature of an explosion, involving generation of a pressure wave. The impact of that pressure wave at different points of a fuse casing may be of different magnitude. Considering the instance that the pressure is substantially equal at all points of the fuse casing, then each semi-cylindrical surface of the casing situated at opposite sides of any of the median planes that can be conceived is subjected to the same aggregate pressure. Consequently the casing is subjected substantially to equal tensile stresses along each of the generatrices thereof. The pressure exerted upon the terminal elements closing the casing results in stresses in a direction longitudinally of the casing. Considering now the more realistic instance that the pressure is not substantially equal at all points of the fuse casing and that it is higher in the region of the casing intermediate its ends than close to its ends. Under such conditions the lateral walls of the casing are subjected to transverse forces tending to bend the casing radially outwardly. The squirrel cage structure which surrounds the casing portion whose wall thickness is uniform forms an effective brace means for receiving the radially outwardly directed forces that tend to bend the lateral walls of the casing. This bracing action is not only desirable in connection with multiply casings as disclosed in the above referred-to patent application of Daniel P. Healey, but in all instances where the pressure distribution inside the casing of a fuse may indicate a bracing action against transverse forces.

It is apparent from the above that the fact that the composite structure 10,21 may be made up of two different materials of which each has different properties may be desirable in many instances. Thus it may be, for instance, desirable to make part 10 of a tubing material having maximal dynamic bursting strength and to make rods 21 of a material best suited for receiving the fasteners 13 for terminal plates 14. The aspect of gas evolution is material as far as part 10 is concerned, but irrelevant as far as rods 21 are concerned. Part 10 may be made of a thermosetting material and rods 21 may safely be made of thermoplastic material since they are not subjected to elevated temperatures.

I claim as my invention:

1. An electric fuse including a. fusible element means;

b. a body of granular arc-quenching filler embedding said fusible element means;

c. a tubular casing portion circular in cross-section having a wall of uniform thickness of a synthetic-resin-glass-cloth laminate, said casing portion housing said fusible element means and said arc-quenching filler;

d. a pair of terminal plates conductively interconnected by said fusible element means juxtaposed to the axially outer edges of said tubular casing portion and closing said tubular casing portion;

e. a plurality of rods of electric insulating material arranged parallel to the axis of said casing portion in abutting relation to the outer surface thereof, said plurality of rods having substantially the same length as said casing portion and being angularly displaced relative to each other; and f. a plurality of fasteners having shanks projecting tranversely through bores in said pair of terminal plates into the end surfaces of said plurality of rods, thus affixing said terminal plates to said casing portion.

2. An electric fuse as specified in claim 1 wherein each of said plurality of rods has a radially inner surface shaped to conform with a strip on said outer surface of said casing portion extending in a direction longitudinally thereof, and each of said plurality of rods being affixed along said radially inner surface thereof to said outer surface of said casing portion.

3. An electric fuse as specified in claim 2 wherein each of said plurality of rods is adhesively bonded to the outer surface of said casing portion.

4. An electric fuse as specified in claim 1 wherein each of said pair of terminal plates includes a circular center region having substantially the same diameter as the outer diameter of said casing portion and wherein said circular center region of each of said pair of terminal plates is provided with a plurality of angularly displaced radially outwardly projecting lugs arranged in registry with the end surfaces of said plurality of rods and having bores for fasteners projecting through said plurality of lugs into said end surfaces of said plurality of rods.

5. An electric fuse as specified in claim 1 wherein said plurality of rods are of a non-glass-cloth reinforced synthetic resin.

6. An electric fuse as specified in claim 1 wherein said tubular casing portion includes an outermost overlapping ply of woven glass fiber cloth, an innermost overlapping ply of woven glass fiber cloth, and an intermediate ply of non-woven glass fiber mat material composed of irregularly oriented glass fibers, said intermediate ply being sandwiched between said outermost ply and said innermost ply.

* * * * *